US009903106B2

(12) United States Patent
Coscarella

(10) Patent No.: US 9,903,106 B2
(45) Date of Patent: Feb. 27, 2018

(54) LOW PROFILE OVERBALANCED BACKWATER VALVE

(71) Applicant: Gabe Coscarella, Edmonton (CA)

(72) Inventor: Gabe Coscarella, Edmonton (CA)

( * ) Notice: Subject to any disclaimer, the term of this patent is extended or adjusted under 35 U.S.C. 154(b) by 0 days.

(21) Appl. No.: 14/520,131

(22) Filed: Oct. 21, 2014

(65) Prior Publication Data

US 2015/0107698 A1 Apr. 23, 2015

(30) Foreign Application Priority Data

Oct. 21, 2013 (CA) ..... 2830404

(51) Int. Cl.
*F16K 33/00* (2006.01)
*E03F 7/04* (2006.01)

(52) U.S. Cl.
CPC ..... *E03F 7/04* (2013.01); *Y10T 137/7407* (2015.04)

(58) Field of Classification Search
CPC ..... Y10T 137/7407; Y10T 137/7381; Y10T 137/7368; Y10T 137/7455; Y10T 137/3077; Y10T 137/7378; Y10T 137/7446; Y10T 137/7404; E03F 7/04; F16K 31/26; F23K 5/14; G01F 23/56; G01F 23/38; H01H 36/02; Y10S 116/42; F22B 37/265
USPC ..... 137/448, 409, 423, 527, 527.2, 527.6, 137/527.8, 520, 521; 251/65, 87, 177, 251/298, 127; 405/39, 96, 97
See application file for complete search history.

(56) References Cited

U.S. PATENT DOCUMENTS 194,676 A 8/1877 Hawses
195,137 A * 9/1877 La Baw ..... F16K 15/03 137/527.6

(Continued)

FOREIGN PATENT DOCUMENTS

CA 2 022 928 C 10/1995
CA 2 114 602 C 7/1997

(Continued)

OTHER PUBLICATIONS

"Adapt-A-Valve Backwater Valves," <http:www.backwater-valves.com/Adapt-A-Valve.asp>, at least as early as Apr. 2009, [retrieved Apr. 20, 2011], 3 pages.

(Continued)

*Primary Examiner* — Craig J Price
(74) *Attorney, Agent, or Firm* — Christensen O'Connor Johnson Kindness PLLC

(57) ABSTRACT

A backwater valve has a hollow valve body with an inlet defined by a vertical surface, an outlet, and a bottom. A pivoting valve member is pivotlly movable about a pivot axis between a normally open position along the bottom of the valve body and a closed, vertical position sealing the inlet. The valve member has a hinge and, the pivot axis being positioned at the hinge end. An overbalancing member carried by the valve member biases the float toward the closed position. The overbalancing member comprises at least one of a counterweight and a magnetic element. The overbalancing member is positioned at the hinge end and spaced from the pivot axis such that the overbalancing member is vertically above the piot axis when the valve member is in the open position and horizontally over from the pivot axis when the valve member is in the closed position.

4 Claims, 8 Drawing Sheets

(56) References Cited

U.S. PATENT DOCUMENTS 197,838 A 12/1877 Downey
199,696 A 1/1878 Dikeman
207,260 A * 8/1878 Downey ..... 137/247.19
217,431 A 7/1879 Tilton
222,389 A 12/1879 Earle
271,644 A 2/1883 Lowrie
289,108 A 11/1883 Johnson
353,888 A 12/1886 Simpkins
371,085 A 10/1887 McGary
373,782 A 11/1887 McHugh
384,396 A 6/1888 Shepherd
384,397 A 6/1888 Shepherd
424,580 A 4/1890 Shepherd
500,453 A 6/1893 Wright
566,110 A 8/1896 Wrigley
633,510 A * 9/1899 Freed ..... F16K 3/08 137/251.1
745,742 A 12/1903 Taube
876,066 A 1/1908 Klever
961,738 A 6/1910 Stickel
993,587 A * 5/1911 Dodd et al. ..... 137/428
1,031,567 A 7/1912 Miller
1,104,806 A 7/1914 Kahn
1,113,648 A 10/1914 Karlson
1,183,692 A 5/1916 Strout
1,205,199 A 11/1916 Healy
1,233,391 A 7/1917 Mullane et al.
1,346,887 A 7/1920 Heald
1,448,898 A * 3/1923 Zehringer ..... 137/240
1,464,614 A 8/1923 Nacey et al.
1,584,666 A 5/1926 Shockley
1,606,396 A 11/1926 Blom
1,612,195 A * 12/1926 Kirchhan et al. ..... 137/445
1,673,619 A 6/1928 Culp
1,692,127 A 11/1928 Keon
1,765,078 A * 6/1930 Khun ..... E03F 7/04 137/445
1,770,637 A 7/1930 Wagner
1,795,669 A 3/1931 Northrop
1,861,397 A 5/1932 Khun
1,864,443 A * 6/1932 Khun ..... 137/445
1,924,498 A 8/1933 House
2,001,941 A 5/1935 Rowe et al.
2,013,188 A 9/1935 Reinhardt
2,048,088 A 7/1936 Wagner
2,259,128 A 10/1941 Egan
2,266,930 A 12/1941 Walson
2,290,461 A * 7/1942 Young ..... 137/399
2,292,509 A 8/1942 Carson
2,303,808 A 12/1942 Wolcott
2,504,006 A 4/1950 Davis
2,578,076 A 12/1951 Kirby
2,628,056 A 2/1953 Fuller
2,638,178 A 5/1953 McRill
2,695,072 A * 11/1954 Hauslein ..... 137/445
2,844,163 A * 7/1958 Steinberg ..... 137/423
2,846,181 A 8/1958 Orelind et al.
2,877,792 A 3/1959 Tybus
2,928,410 A 3/1960 Del Vecchio
3,074,427 A 1/1963 Wheeler, Jr.
3,077,203 A * 2/1963 Wolsh ..... 137/392
3,078,867 A 2/1963 McGillis et al.
3,166,083 A * 1/1965 Girden ..... 137/388
3,176,707 A 4/1965 Wilson
3,182,951 A * 5/1965 Spencer ..... 251/85
3,244,194 A 4/1966 Henry
3,270,770 A 9/1966 Wilson
3,307,633 A 3/1967 Newall
3,327,732 A 6/1967 Deve
3,395,721 A 8/1968 Shibata
3,446,237 A 5/1969 Haley
3,448,465 A 6/1969 Pierce et al.
3,538,514 A 11/1970 Schimert et al.
3,565,099 A 2/1971 Huber
3,566,500 A 3/1971 Simon
3,626,148 A 12/1971 Woytowich et al.
3,626,521 A 12/1971 Delco
3,720,225 A 3/1973 Wheatley, Jr.
3,726,308 A 4/1973 Eberhardt
3,781,920 A 1/1974 Browne et al.
3,797,811 A 3/1974 Jullien et al.
3,824,629 A 7/1974 Shiley
3,828,982 A 8/1974 Steigerwald
3,933,444 A 1/1976 Kilgore
3,948,282 A 4/1976 Yano
3,959,828 A 6/1976 Acevedo
3,974,654 A 8/1976 Mirto, Jr.
4,022,421 A 5/1977 Carlin
4,063,570 A 12/1977 Mitchell et al.
4,064,902 A 12/1977 Swenson
4,095,615 A 6/1978 Ramsauer
4,117,860 A 10/1978 Carlin
4,266,569 A 5/1981 Wilson
4,311,163 A 1/1982 Langevin
4,314,583 A 2/1982 Peterson
4,324,506 A 4/1982 Steinke
4,391,289 A 7/1983 Adams
4,475,571 A 10/1984 Houston, Jr. et al.
4,477,051 A 10/1984 Ben-Yehuda
4,503,881 A * 3/1985 Vecchio ..... 137/425
4,544,027 A 10/1985 Goldberg et al.
4,600,034 A * 7/1986 Ko ..... 137/554
4,605,031 A 8/1986 Grund
4,777,979 A * 10/1988 Twerdochlib ..... 137/554
4,787,103 A 11/1988 Endo
RE32,870 E 2/1989 Houston, Jr. et al.
4,844,610 A 7/1989 North, Jr.
4,852,605 A 8/1989 Gouhier
4,891,994 A 1/1990 Barba
4,917,147 A 4/1990 Jerkins
4,942,898 A * 7/1990 Osowski ..... 137/454.2
4,961,444 A 10/1990 Morgan et al.
5,020,567 A 6/1991 Proulx
5,031,659 A 7/1991 Gonzales et al.
5,113,901 A * 5/1992 Young ..... 137/554
5,123,444 A * 6/1992 Persson et al. ..... 137/578
5,159,950 A * 11/1992 Wang ..... 137/390
5,165,655 A 11/1992 Drexel et al.
5,209,454 A * 5/1993 Engdahl et al. ..... 251/65
5,234,018 A 8/1993 Grachal et al.
5,398,722 A 3/1995 Ramsey
5,398,735 A 3/1995 Lagache
5,406,972 A * 4/1995 Coscarella et al. ..... 137/315.08
5,469,881 A 11/1995 Phan et al.
5,622,205 A 4/1997 Petersen
5,669,405 A 9/1997 Engelmann
5,755,257 A * 5/1998 Feucht et al. ..... 137/424
5,779,223 A 7/1998 Marbach
5,785,297 A 7/1998 Ha
5,794,655 A 8/1998 Funderburk et al.
5,819,791 A 10/1998 Chronister et al.
5,826,609 A 10/1998 Watts
5,934,313 A 8/1999 Brothers et al.
5,947,152 A 9/1999 Martin et al.
6,029,684 A 2/2000 Watts
6,068,057 A 5/2000 Beukema
6,125,878 A 10/2000 Watts
6,178,985 B1 * 1/2001 Robinson ..... 137/195
6,186,164 B1 2/2001 Pfeifer et al.
6,192,926 B1 2/2001 Bueno Lopez
6,305,411 B1 10/2001 Youssef
6,318,404 B2 * 11/2001 Coscarella ..... 137/420
6,446,665 B2 9/2002 Coscarella
6,499,503 B2 12/2002 Coscarella
6,666,277 B2 12/2003 Reilly
6,679,283 B1 1/2004 Coscarella
6,935,844 B1 * 8/2005 Dukes et al. ..... 137/418
7,152,615 B1 * 12/2006 Engdahl ..... 137/554
7,152,622 B2 12/2006 Scaramucci et al.
7,942,606 B2 5/2011 Schafer
8,578,961 B2 * 11/2013 Coscarella ..... 137/448
9,097,363 B2 * 8/2015 Coscarella
2001/0023706 A1 9/2001 Coscarella
2001/0023707 A1 9/2001 Coscarella

(56) References Cited

U.S. PATENT DOCUMENTS

| | | | | |
|---|---|---|---|---|
| 2001/0023708 | A1 | 9/2001 | Coscarella | |
| 2001/0035648 | A1 | 11/2001 | Coscarella | |
| 2004/0007265 | A1 | 1/2004 | Coscarella | |
| 2004/0250863 | A1 | 12/2004 | Atkeson et al. | |
| 2008/0083464 | A1 | 4/2008 | Shimizu et al. | |
| 2008/0128026 | A1 | 6/2008 | Ringer | |
| 2010/0078083 | A1* | 4/2010 | Coscarella | 137/527 |

FOREIGN PATENT DOCUMENTS

| | | | |
|---|---|---|---|
| CA | 2 302 455 | A1 | 9/2001 |
| CA | 2 339 465 | A1 | 7/2002 |
| CA | 2 344 321 | A1 | 10/2002 |
| CA | 2 568 098 | A1 | 4/2008 |
| FR | 2738269 | A1 | 3/1997 |
| GB | 21 646 | A | 6/1911 |

OTHER PUBLICATIONS

"Zurn Z1091 Backwater Valve Flapper Type," at least as early as Oct. 2009, 1 page.
"Zurn Z1019 Funnel Drain with P Trap," at least as early as Dec. 2000, 1 page.

* cited by examiner

LOW PROFILE OVERBALANCED BACKWATER VALVE

FIELD

The present invention relates to a backwater valve used to prevent a backflow of sewage into a home.

BACKGROUND

U.S. Pat. No. 5,406,972 (Coscarella et al.) relates to a backwater valve which prevents a backflow of sewage into a home. This backwater valve needs a minimum amount of clearance space. As a result, there are some installations for which the valve is not suited because there is insufficient clearance space.

SUMMARY

According to an aspect, a backwater valve comprises a hollow valve body having an inlet defined by a vertical surface, an outlet, and a bottom. A pivoting valve member is pivotally movable about a pivot axis between a normally open position along the bottom of the valve body and a closed, vertical position sealing the inlet. The valve member has a peripheral edge comprising a hinge end, a remote end, and opposed sides, the pivot axis being positioned at the hinge end. An overbalancing member carried by the valve member biases the float toward the closed position when in the closed position. The overbalancing member comprises at least one of a counterweight and a magnetic element. The overbalancing member is positioned at the hinge end and spaced from the pivot axis such that the overbalancing member is vertically above the pivot axis when the valve member is in the open position and horizontally over from the pivot axis when the valve member is in the closed position.

According to another aspect, the overbalancing member is a magnetic element and the valve body comprises a second magnetic element, where at least one of the magnetic element and the second magnetic element is magnetized.

According to another aspect, the overbalancing member is a counterweight.

BRIEF DESCRIPTION OF THE DRAWINGS

These and other features will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION

Figure 1:
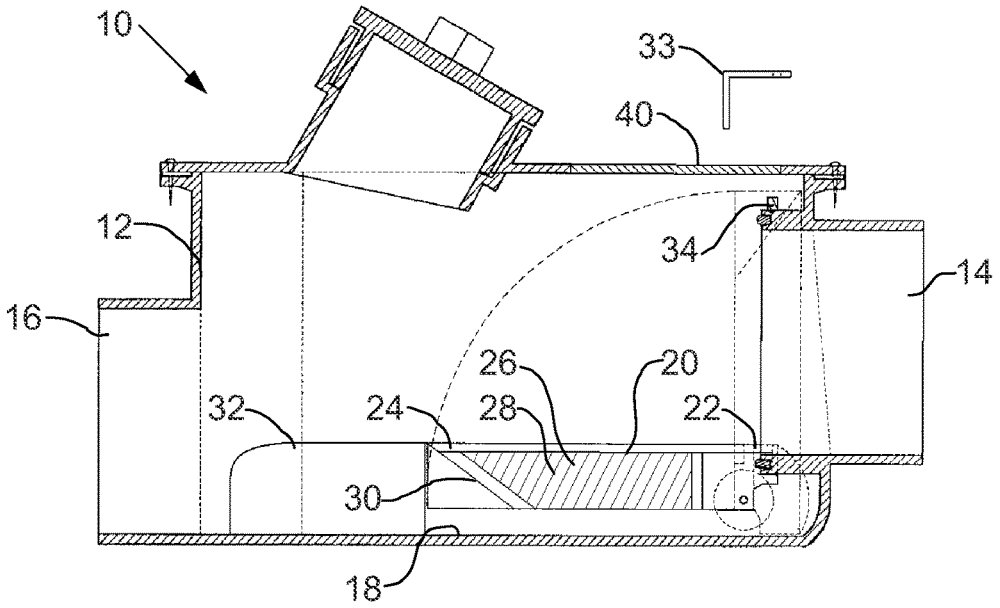
FIG. 1 is a side elevation view in section of a low profile backwater valve.

A low profile backwater valve generally identified by reference numeral 10 will now be described with reference to FIGS. 1-7.

Structure and Relationship of Parts:

Referring to FIG. 1, backwater valve 10 has a hollow valve body 12 having an inlet 14, an outlet 16, and a bottom 18. A pivoting valve member 20 is pivotally movable between a normally open position along bottom 18 of valve body 12 and a closed position sealing inlet 14. Valve member 20 has a hinge end 22, a remote end 24, and opposed sides 26.

In the example depicted in FIGS. 1-7, backwater valve 10 is a low profile backwater valve and this is described below. It will be understood that the overbalancing element depicted in FIGS. 6 and 7 may be applied to other types of backwater valves as well. However, it has been found that low profile backwater valve 10 of the type depicted are particularly susceptible to "flutter," where changes in the backflow may cause valve member 20 to open prematurely.

Figure 2:
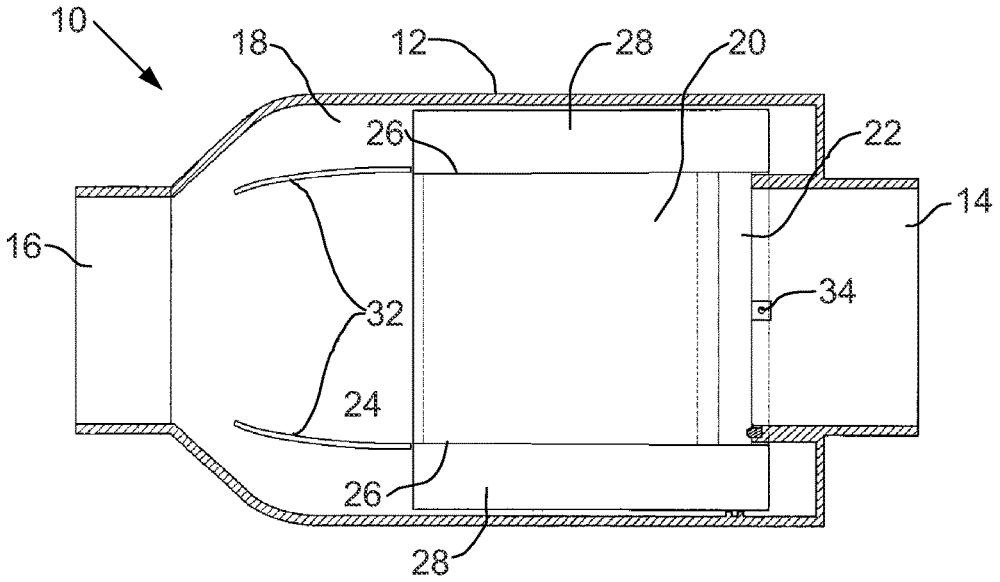
FIG. 2 is a top plan view in section of the low profile backwater valve.
Figure 5:
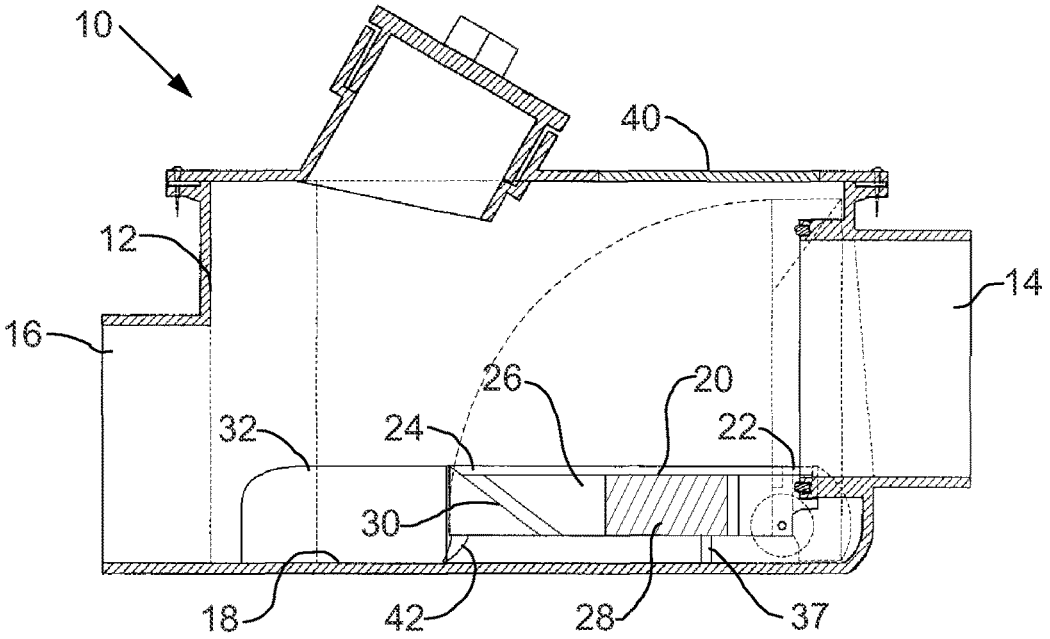
FIG. 5 is a side elevation view in section of a further variation of the low profile backwater valve.

A float 28 is positioned as an appendage along at least one opposed side 26 of valve body 12. Referring to FIG. 2, floats 28 are preferably positioned along both sides 26. Float 28 adds buoyancy to valve member 20, such that valve member 20 floats into the closed position in the presence of a backflow. Valve member 20 may be made from buoyant material itself, in which case it may not be necessary to provide floats 28. However, it may be desired to enhance the buoyancy of valve member 20 by including other floats. By placing floats 28 on the side, it enables valve member 20 to be designed with a lower profile within valve body 12 than would otherwise be possible. Referring to FIG. 1, in some embodiments, a locking means, such as a locking member 33 as shown, may be provided to lock valve member 20 into the closed position. In the depicted embodiment, locking member 33 is inserted over valve member 20 in the closed position and engages a pin 34 to hold it in position. Referring again to FIG. 1, the portion of float 28 at remote end 24 of valve member 20 preferably defines an inclined plane 30, such that the force of a backflow striking inclined plane 30 lifts valve member 20 toward the closed position. Referring to FIG. 5, inclined plane 30 may also be independent of float 28. For example, inclined plane 30 may be an outward extension of, or otherwise attached to valve member 20, with floats either positioned away from inclined plane 30 as shown, or not included on sides 26 of valve member 20. In some embodiments, where valve member 20 is sufficiently buoyant, it may not be necessary to include floats 28.

Figure 3:
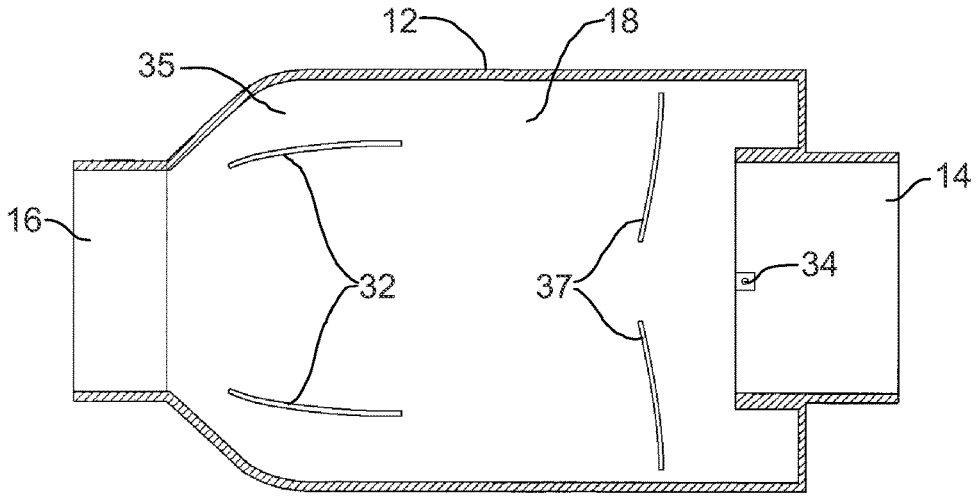
FIG. 3 is a top plan view of a variation of the low profile backwater valve with the valve body removed.
Figure 4:
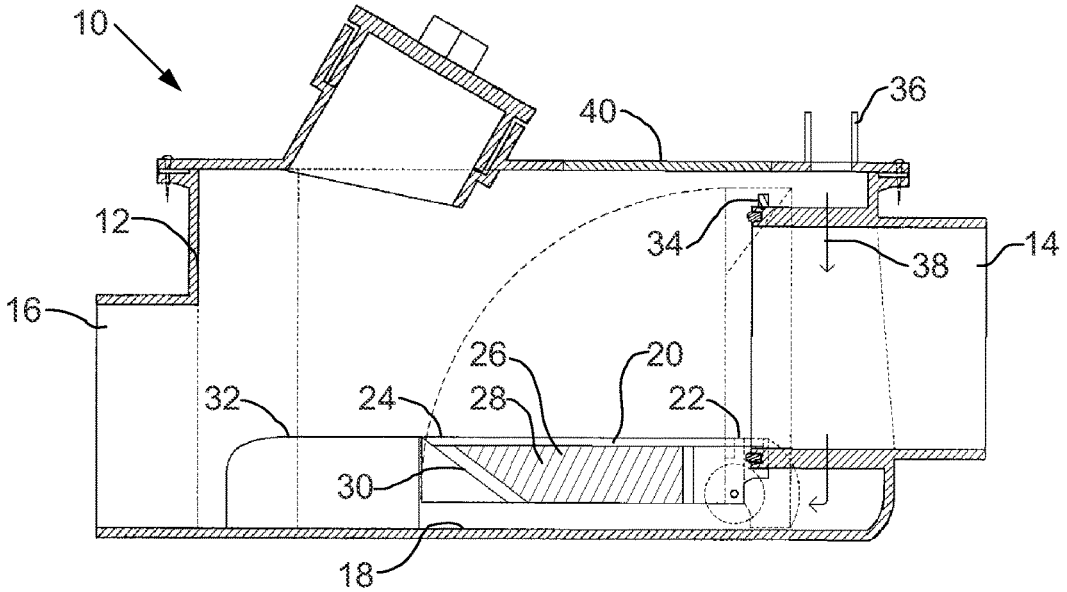
FIG. 4 is a side elevation view of a further variation of the low profile backwater valve.

It has been found that debris and other contaminants can cause difficulties in the operation of backwater valve 10. To counter this, certain features may be used. Referring to FIG. 3, baffles 32 may extend vertically from bottom 18 of valve body 12 to define flow channels 35 directing flow toward float 28. Referring to FIG. 4, a hose coupling 36 may be provided on valve body 12 with a passage indicated by arrows 38 to flush underneath valve member 20 to remove debris that might collect between valve member 20 and bottom 18 of valve body 12. Referring to FIG. 3, baffles or dams 37 extend vertically from the bottom of the valve body protecting the hinge end of the valve member from contamination. Alternatively, referring to FIG. 5, baffles 37 may extend from the bottom of valve body 20. In addition to baffles 32 and 37, valve member 20 may carry a seal 42 at remote end 24 to help prevent any debris carried by water from flowing under valve member 20. Referring to FIG. 4, valve body 12 may also have a transparent top 40 to facilitate visual inspection.

Operation:

Referring to FIGS. 1 and 2, low profile backwater valve 10 is installed to allow water to flow from inlet 14 to outlet 16. If the flow of water reverses to flow from outlet 16 to inlet 14, the flow is directed by baffles 32 toward inclined plane 30 on float 28. The flow against plane 30, as well as the buoyancy of floats 28, causes valve member 20 to rise and ultimately close to prevent flow out of inlet 14. The actual combination of these forces that closes valve member 20 will depend on the rate of flow of backwater. For example, if the rate of flow is high, the force of impact on inclined plane 30 may be sufficient to cause valve member 20 to close, or merely enough to lift valve member 20 partially. If the rate of flow is slower, the buoyancy of valve member 20 will cause valve member 20 to close.

Referring to FIG. 3, bottom 18 is contoured and provided with baffles 32 to direct the flow of water to close valve member 20 as well as baffles 37 to allow water that may carry debris and contaminants, such as dirt, to drain away from valve member 20 and hinge end 22. This helps prevent valve member 20 from accumulating debris between valve member 20 and bottom 18, or by causing hinge end 22 to become immobilized. Referring to FIG. 4, transparent top 40 allows a visual inspection of backwater valve 10. If it becomes apparent from a visual inspection or otherwise that valve member 20 is not operating properly, hose coupling 36 allows a cleaning fluid to be flushed through to clean backwater valve 10.

Figure 6:
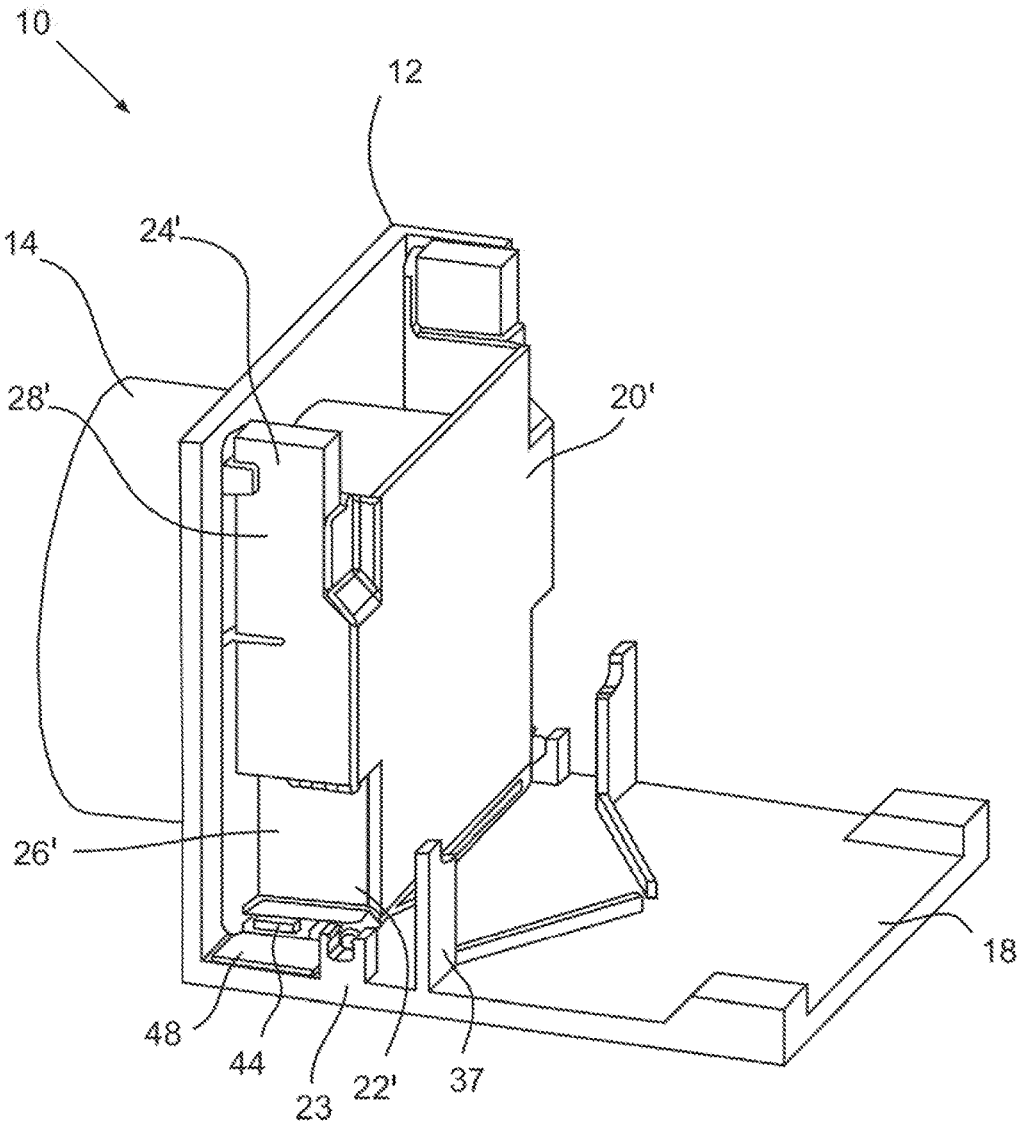
FIG. 6 is a perspective view of a variation of a low profile backwater valve.
Figure 7:
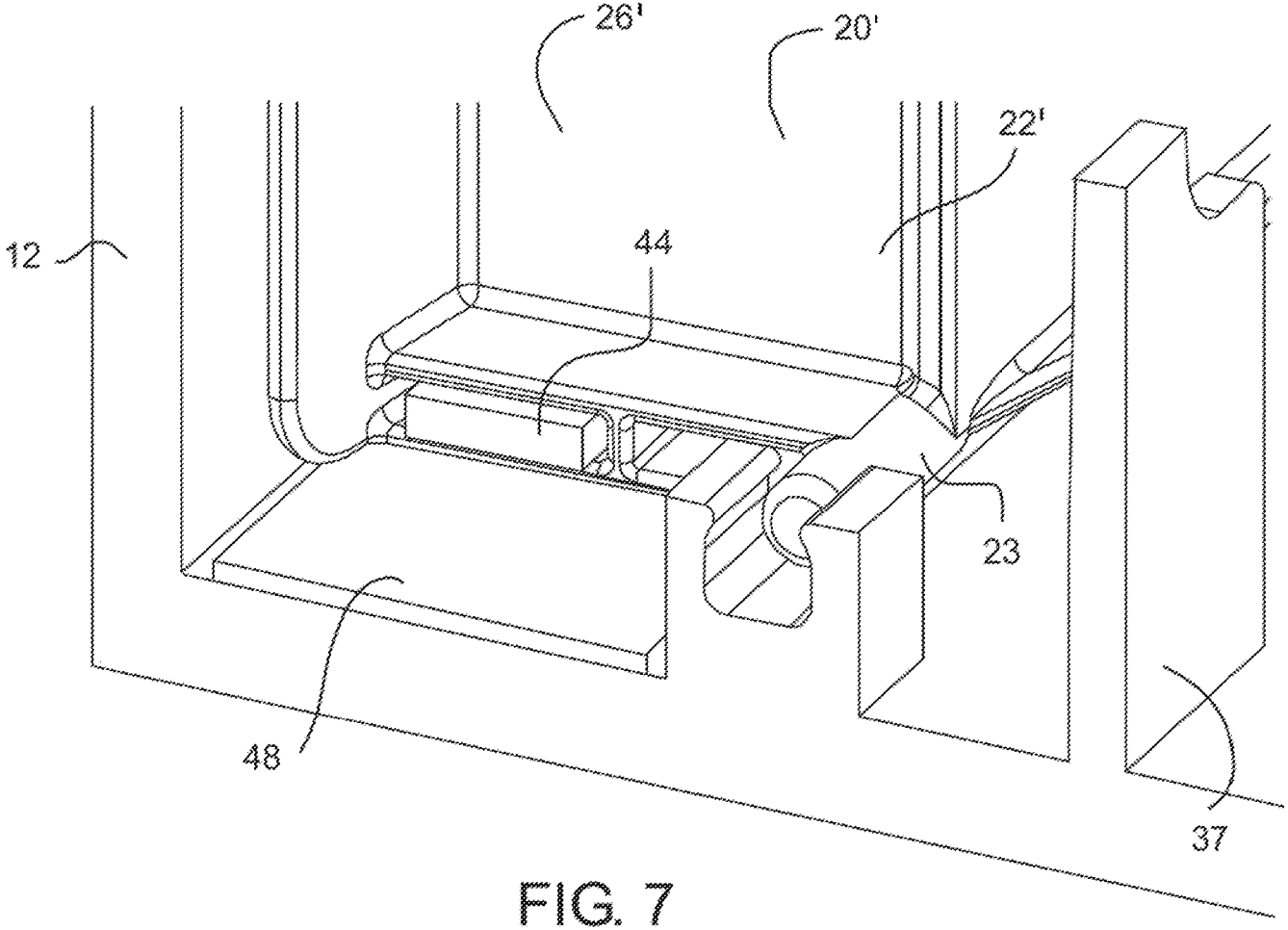
FIG. 7 is an exploded perspective view of the low profile backwater valve in FIG. 6.
Figure 8:
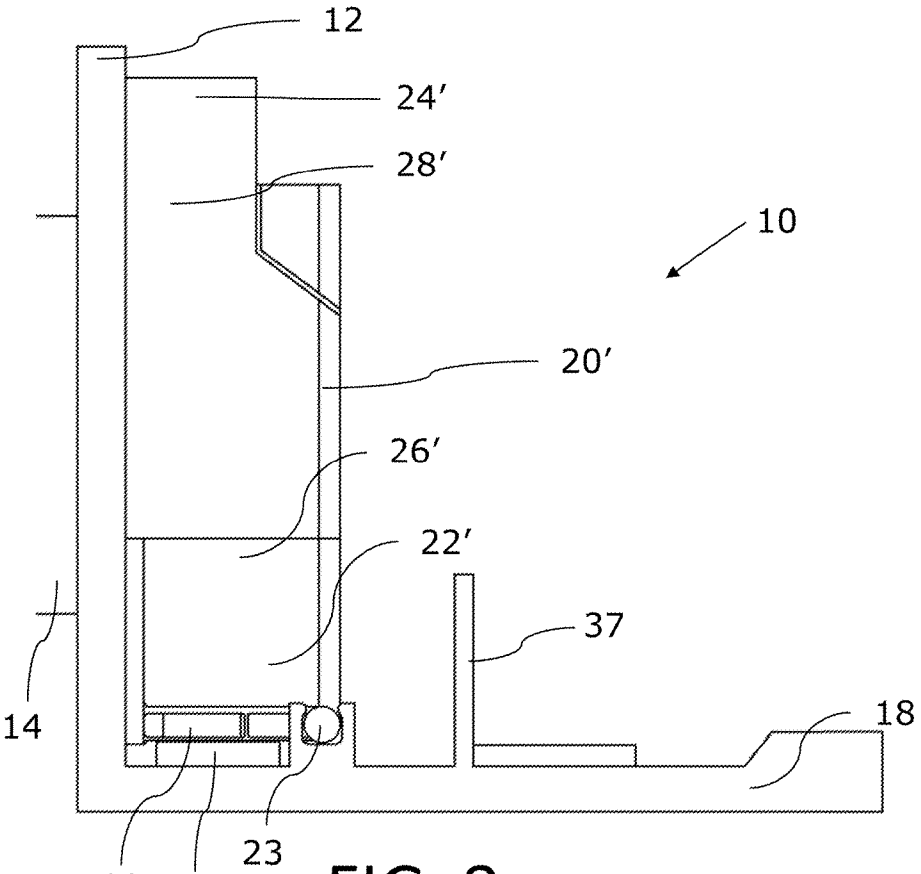
FIG.8 is a side elevation view of FIGS. 6 and 7, shown in the closed position.
Figure 9:
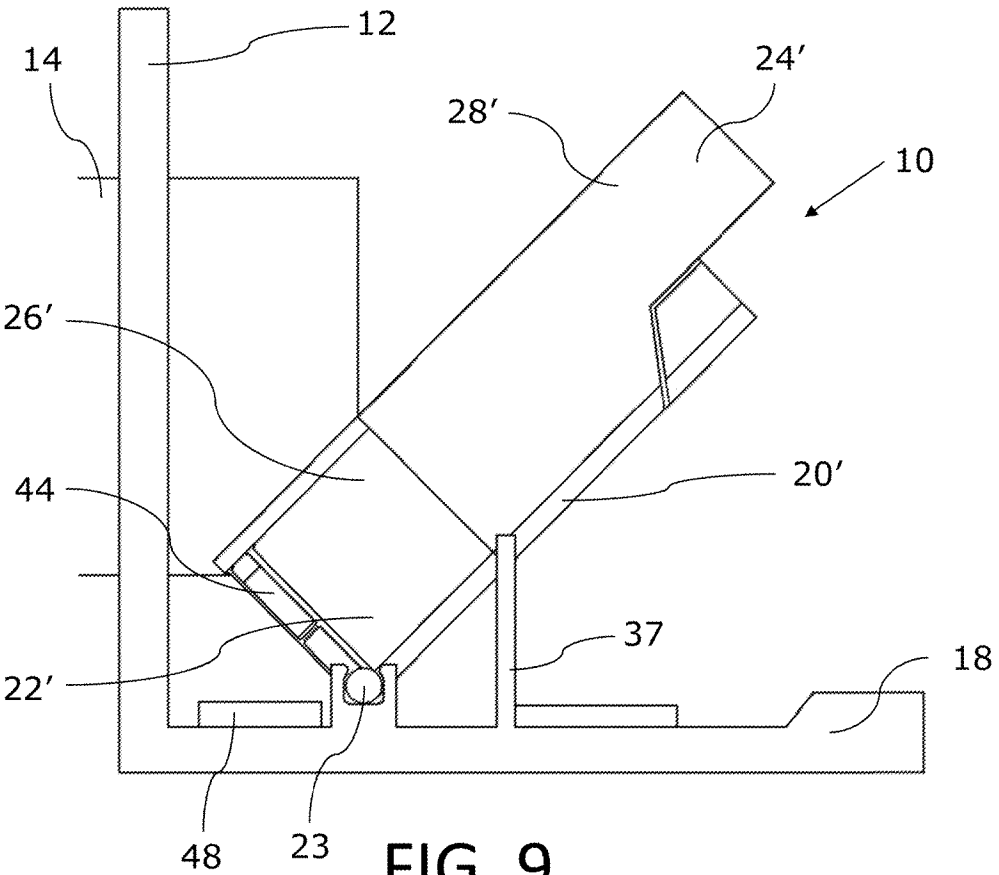
FIG. 9 is a side elevation view of FIGS. 6 and 7, shown in an intermediate position.
Figure 10:
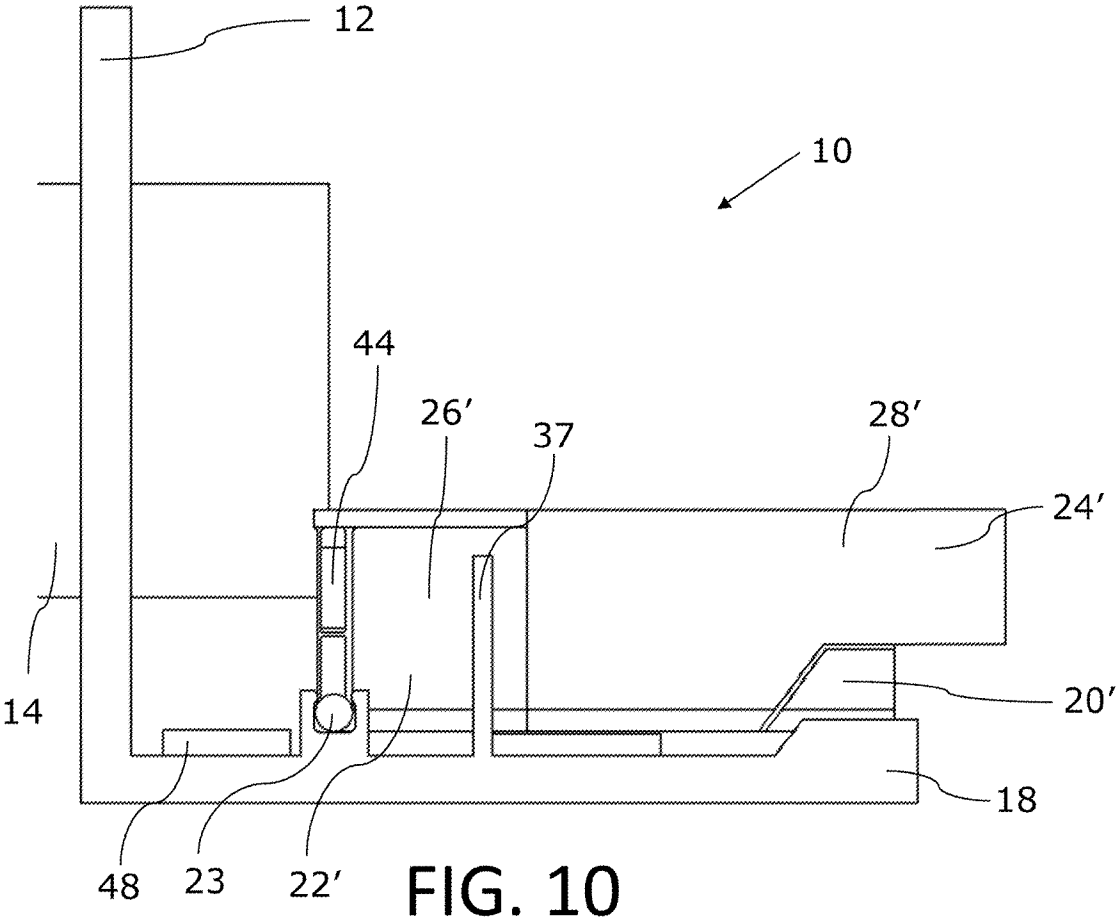
FIG. 10 is a side elevation view of FIGS. 6 and 7, shown in a fully open position.

Referring to FIGS. 6 and 7, in a preferred embodiment valve member 20', with hinge end 22', remote end 24', opposed sides 26', and floats 28', is provided with additional support to remain in the closed position. This may be done by providing an overbalancing element 44, such as a counterweight or magnet, to help maintain valve member 20' in the closed position until sufficient pressure from the regular flow has been achieved and the backwater flow has receded. Overbalancing element 44 may be positioned on one side of valve member 20'or both sides of valve member 20'. Valve member 20' is shown in a closed position in FIGS. 6 and 7. Referring to FIGS. 8, 9, and 10, valve member 20' is shown moving between the closed position in FIG. 8 and the open position in FIG. 10. The valve member 20' extends from the pivot axis along a first axis and the overbalancing member 44 extends from the pivot axis along a second axis, the second axis being perpendicular to the first axis and intersecting the first axis at the pivot axis.

In one embodiment, overbalancing element 44 may be a counter weight, such that the additional weight maintains valve member 20' in the closed position. As can be seen, overbalancing element 44 is positioned at the hinge end 22' of valve member 20' and spaced from the pivot axis 23 such that, in the closed position, counterweight 44 moves along a path that is initially vertical or substantially vertical, to maximize the amount pressure required to lift counterweight 44 as valve member 20' pivots to the open position and that, in the open position, it is directly above pivot axis 23, so that counterweight 44 initially moves horizontally to minimize the amount of upward force required to move valve member 20' to the closed position.

In another embodiment, overbalancing element 44 may be a magnetic element carried by valve member 20' that is magnetically attracted to a second magnetic element 48 carried by valve body 12. At least one of magnetic element 44 and second magnetic element 48 is magnetic and the other may be ferrous. To increase the attraction, both elements 44 and 48 may be magnetic with opposite poles facing the other. Overbalancing element 44 is preferably positioned in the same general position as in the embodiment that involves a counterweight as overbalancing element 44 may increase the weight and also act as a counterweight. In addition, the spacing of magnet is element 44 from pivot axis 23 acts as a lever to increase the effect of the magnetic attraction between magnetic element 44 and second magnetic element 48. Depending on the size and type of magnetic material, magnetic element 44 may be heavy enough that it also acts as a counterweight. Magnetic element 44 engages second magnetic element 48 near hinge end 22' of valve member 20' when valve member 20' is in a closed position.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A backwater valve, comprising:

a hollow valve body having an inlet defined by a vertical surface, an outlet, and a bottom;

a pivoting valve member pivotally movable about a pivot axis that is positioned below the inlet between a normally open position along the bottom of the valve body and a closed, vertical position sealing the inlet, the pivoting valve member having a peripheral edge comprising a hinge end, a remote end, and opposed sides, the pivot axis being positioned at the hinge end, the pivoting valve member carrying a float; and an overbalancing member carried by the pivoting valve member that biases the pivoting valve member toward the closed position, the overbalancing member comprising at least one of a counterweight and a magnetic element, the overbalancing member being positioned at the hinge end and spaced from the pivot axis such that the overbalancing member is vertically aligned with and above the pivot axis when the pivoting valve member is in the open position and horizontally aligned with and over from the pivot axis when the pivoting valve member is in the closed position, wherein, in each of the open and closed positions the pivoting valve member extends from the pivot axis along a first axis and the overbalancing member extends from the pivot axis along a second axis, the second axis being perpendicular to the first axis and intersecting the first axis at the pivot axis.

2. The backwater valve of claim 1, wherein the overbalancing member is a magnetic element and the valve body comprises a second magnetic element, at least one of the magnetic element and the second magnetic element being magnetized.

3. The backwater valve of claim 1, wherein the overbalancing member is a counterweight.

4. A backwater valve, comprising:

a hollow valve body having an inlet defined by a vertical surface, an outlet, and a bottom;

a pivoting valve member pivotally movable about a pivot axis that is positioned below the inlet between a normally open position along the bottom of the valve body and a closed, vertical position sealing the inlet, the pivoting valve member having a peripheral edge comprising a hinge end, a remote end, and opposed sides, the pivot axis being positioned at the hinge end, the pivoting valve member carrying a float; and an overbalancing member carried by the pivoting valve member that biases the pivoting valve member toward the closed position, the overbalancing member comprising at least one of a counterweight and a magnetic element, the overbalancing member being positioned at the hinge end and spaced from the pivot axis such that, when the pivoting valve member moves between the open position and the closed position the overbalancing member travels within a region that is vertically above the pivot axis, and wherein the overbalancing member is vertically aligned with and directly above the pivot axis when the pivoting valve member is in the open position and horizontally aligned with and spaced horizontally over from the pivot axis when the pivoting valve member is in the closed position.

* * * * *